US006414647B1

(12) United States Patent
Lee

(10) Patent No.: US 6,414,647 B1
(45) Date of Patent: Jul. 2, 2002

(54) SLENDER OMNI-DIRECTIONAL, BROAD-BAND, HIGH EFFICIENCY, DUAL-POLARIZED SLOT/DIPOLE ANTENNA ELEMENT

(75) Inventor: Joseph C. Lee, Lexington, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/885,326

(22) Filed: Jun. 20, 2001

(51) Int. Cl.[7] ..... H01Q 9/16; H01Q 21/00

(52) U.S. Cl. ..... 343/793; 343/727; 343/770; 343/792

(58) Field of Search ..... 343/725, 727, 343/793, 810, 791, 792, 767, 770

(56) References Cited

U.S. PATENT DOCUMENTS

| | | | | |
|---|---|---|---|---|
| 2,174,353 A | | 9/1939 | Roberts | 342/361 |
| 2,324,462 A | | 7/1943 | Leeds et al. | 343/742 |
| 2,953,782 A | | 9/1960 | Byatt | 342/428 |
| 3,474,452 A | | 10/1969 | Bogner et al. | 343/726 |
| 3,665,479 A | | 5/1972 | Silliman | 343/726 |
| 4,451,829 A | | 5/1984 | Stuckey, Jr. et al. | 343/705 |
| 4,710,775 A | | 12/1987 | Coe | 343/727 |
| 4,839,663 A | | 6/1989 | Kurtz | 343/771 |
| 4,899,165 A | * | 2/1990 | Schadler | 343/727 |
| 4,907,008 A | * | 3/1990 | Dienes | 343/727 |
| 5,021,797 A | | 6/1991 | Dienes | 343/727 |
| 5,105,199 A | * | 4/1992 | Ukmar | 174/28 |
| 5,426,439 A | | 6/1995 | Grossman | 343/727 |

FOREIGN PATENT DOCUMENTS

| | | |
|---|---|---|
| GB | 2165396 A | 10/1984 |
| JP | 59012601 | 1/1984 |
| JP | 1100851 | 4/1990 |

OTHER PUBLICATIONS

Circularly–Polarized Omnidirectional Antenna, George H. Brown, et al., RCA Review, 259–69 (1947).

The Omnidirectional Circular Antenna Array, T. Spencer, International Confernece on Antennas for Aircraft and Spacecraft, 178 (1975).

Antennas, John D. Kraus, 173 (1950).

Helical Antenna for Circular Polarization, Harold A. Wheeler, Proceedings of the Institute of Radio Engineers, 1484–1487 (1947).

A Slender–Resonator Slot UHF Antenna, Joseph C. Lee, IEE Antenna Propagation Conference, 442–46 (1981).

A UHF Buoyant Antenna, M.S. Smith, et al., ICAP, 273 (1987).

The Patterns of Slotted–Cylinder Antennas, G. Sinclair, Proceedings of the Institute of Radio Engineers, 1487–1492 (1948).

* cited by examiner

*Primary Examiner*—Tan Ho
(74) *Attorney, Agent, or Firm*—Choate, Hall & Stewart; Anne-Marie Dinius, Esq.

(57) ABSTRACT

The present invention is directed toward a dual linear or circular polarized antenna comprised of two orthogonally linearly polarized radiative elements. More specifically, the present invention is for a slender slot-dipole antenna, where the slot and the dipole are located in the same physical structure. Feed line interference to the antenna can be eliminated by including a centrally located shaft. The antenna of the present invention can be used as either a receive antenna or a transmitting antenna and could be used to form an array. In one embodiment, the antenna is comprised of two substantially cylindrical members, wherein the slot is located on the outer surface of the antenna and the cylindrical members function as dipoles. Other embodiments are directed toward multiple slots and polygonal-shaped antennas.

25 Claims, 9 Drawing Sheets

190
196
RHCP PORT
LHCP PORT
197
90° Hybrid
194
Power Divider
193
to α
to β
to γ
α
β
γ
40
15
20
12
50
150
115
120
191
140
175
198
17
192
117
β
10 (30)
110 (130)

$n = 3$
$\theta_3 = 120°$ $n = 4$
$\theta_4 = 90°$ $n = 6$
$\theta_6 = 60°$

SLENDER OMNI-DIRECTIONAL, BROAD-BAND, HIGH EFFICIENCY, DUAL-POLARIZED SLOT/DIPOLE ANTENNA ELEMENT

GOVERNMNET SUPPORT

This invention was made with government support under Contract Number F19628-95-C-0002 awarded by the Department of the Air Force. The government has certain rights in the invention.

BACKGROUND OF THE INVENTION

A wide variety of organizations, such as military, aerospace, aeronautical, nautical, and telecommunications industries use dual polarized electromagnetic waves as a means of transmitting and receiving information. In order to enable the transmission and reception of dual polarized waves, it is necessary to employ dual polarized antennas. In these industries there are many known types of dual polarized antennas, some of which are discussed below.

It has long been recognized in the study of electromagnetics that a circularly polarized wave may be thought of as being comprised of two orthogonal, linearly polarized waves, i.e., a vertically polarized wave and a horizontally polarized wave. Using what has become a well-known concept, Walter van B. Roberts obtained a patent for a circularly polarized antenna comprised of a vertically polarized dipole element and a horizontally polarized loop element. See U.S. Pat. No. 2,174,353 "Transmission of Waves with Rotary Polarization,"(1939), the contents of which are hereby incorporated by reference. This patent took advantage of the fact that a dipole and a loop are complementary antenna pairs. They have exactly the same radiation pattern, but have cross-polarized fields.

In the years since the Roberts' patent issued, antenna engineers have continued to be fascinated by the idea of using a loop-dipole combination antenna as a means of constructing a circularly polarized antenna. See e.g., George H. Brown et al., *Circularly-Polarized Omnidirectional Antenna*, RCA Review, 259–69 (1947); U.S. Pat. Nos. 2,324,462 (Leeds et al. 1943); U.S. Pat. No. 2,953,782 (Byatt 1960); U.S. Pat. No. 3,474,452 (Bogner 1969); and U.S. Pat. No. 3,665,479 (Silliman 1972), and more recently, two Japanese patents, JP 59012601 (1984) and JP 1100851 (1990), each of the contents of which are hereby incorporated by reference. Although the combination of a loop and a dipole may appear to be straightforward to implement, there are, in fact, many systemic limitations that reduce the functionality of this combination. For example, loop antennas are characterized by a very narrow bandwidth, which results in a lossy antenna that is useful only over a very small frequency band. In addition, parasitic interference in the feeding network used to power the loop-dipole combination can be difficult to overcome. Moreover, achieving the proper balance in amplitude and phase over a required bandwidth is a nontrivial exercise.

In the past, engineers have attempted to compensate for these design shortcomings in a variety of ways, including replacing the loop and/or dipole with another type of antenna element or varying the physical location of the loop relative to the dipole. An article published in 1975 illustrates an example of replacing the loop element with alternative elements, in this case multiple tilted or bent half-wave electric dipoles. See Spencer, T., *The Omnidirectional Circular Antenna Array*, International Conference on Antennas for Aircraft and Spacecraft, 178 (1975), the contents of which are hereby incorporated by reference. Although this configuration mitigated some of the limitations of the loop-dipole combination, the resulting antenna was impractical for many uses because of its large physical cross-section.

Antenna engineers have alternatively substituted a slot on a hollow conductive cylinder for the loop in the dipole-loop antenna and have thus used a slot-dipole combination to create a circularly polarized antenna. In order for a slot to be an effective radiating element, many of the prior art slot antennas' designs, which required back-cavities of about a quarter wavelength deep or half wavelength in cross-sectional circumference, resulted in prohibitively large antenna elements when the slot and dipole were collocated in the same physical structure. The following U.S. Patents are directed toward a dipole-slot antenna: U.S. Pat. No. 4,710,775 to Coe; U.S. Pat. No. 4,839,663 to Kurtz; U.S. Pat. No. 4,451,829 to Stuckey, Jr. et al.; U.S. Pat. No. 5,021,797 to Dienes; and U.S. Pat. No. 5,426,439 to Grossman, each of the contents of which are hereby incorporated by reference.

An additional example of a circularly polarized antenna is the helix. A helical antenna is, in essence, superposed electrical dipole and loop, which is a magnetic dipole. This superposition can create a circularly polarized antenna. Most helices are used in the axial mode to radiate end-fire patterns. In theory, a helix operating in the normal mode can produce a circularly polarized field with an omni radiation pattern normal to the helix's axis. JOHN D. KRAUS, ANTENNAS, 173 (1950). The drawback of a normal-mode helix, which is inherent because of its design, is its extremely high radiated "Q". A high Q radiated value for an antenna is indicative of low efficiency and of a narrow bandwidth. Harold A. Wheeler, *Helical Antenna for Circular Polarization*, Proceedings of the Institute of Radio Engineers, 1484, 1487 (1947), the contents of which are hereby incorporated by reference.

An additional alternative, which is likewise used in place of a loop-dipole combination antenna, is cross-dipoles. Although cross-dipoles are an efficient antenna, they are end-fire. Using multiple cross-dipoles in a circular array to form an omni-directional antenna is one way of overcoming this end-fire limitation. The problem with using multiple cross-dipoles is the amount of physical space required to implement the design, which is often prohibitive.

In addition to varying the types of antenna elements used to construct circularly polarized antennas, engineers have also varied the physical locations of the loop or dipole elements relative to each other in an attempt to improve the antenna performance. For example, Leeds et al. located a dipole in the center of a loop in U.S. Pat. No. 2,324,462 (1943). See also U.S. Pat. No. 2,953,782 issued to Byatt (1960). Bogner and Silliman placed dipoles on the outer edge of the loops in their U.S. Pat. Nos. 3,474,452 (1969) and 3,665,479, (1972) respectively. Each of these antennas was impractical because the size was too large for many applications and because the feed lines used for receiving and transmitting power caused interference.

SUMMARY OF THE INVENTION

The loop-dipole antennas and variations thereof disclosed in the prior art are large in size, cumbersome in form, and inefficient in performance. Many of these prior art antennas experience feed line and supporting structure interference problems, resulting in performance degradation. The present invention overcomes many of these drawbacks. All embodiments disclosed herein use the same physical components to perform both the electric dipole and the loop antenna functions. These embodiments maximizes the slot antenna gain for a given cross-section size, while maintaining a simple donut-shaped radiation pattern for both orthogonal polarizations. Feed line and supporting structure interference and stray radiation problems are also eliminated in the present invention by housing them inside of a hollow shaft, which can be included in the invention. The present inventive antenna is useful as a longitudinal antenna or in linear array applications.

In one embodiment, the antenna element is comprised of two substantially cylindrical members of nearly equal length, wherein each member is further comprised of a capacitively loaded axial slot. The exterior of this embodiment acts as a dipole, wherein the slots are short-circuited at one end and form an open circuit at the other end. An alternative embodiment is comprised of two substantially polygonal members of nearly equal length, wherein each member is further comprised of a capacitively loaded axial slot. The exterior of this embodiment acts as a dipole, wherein the slots are short-circuited at one end and form an open circuit at the other end. Yet another embodiment of the present invention comprises more than one slot spaced evenly on the peripheral surface of the antenna.

Another embodiment is comprised of core material with high permeability located in the center of the antenna element. In addition, the antenna element of the present invention could be configured in an array by using a plurality of antennas designed in accordance with the principles disclosed herein. Additional embodiments of the antenna include design aspects directed toward increasing the bandwidth and efficiency of the slot portion of the antenna, while maintaining a relatively symmetrical donut-shaped radiation pattern.

BRIEF DESCRIPTION OF THE DRAWING

The invention is described with reference to the several figures of the drawing, in which, FIGS. 1(*a*), (*b*), and (*c*) are plots of the theoretical radiation pattern of the antenna disclosed herein;

FIG. 3(*b*) is a diagram of a feeding network that can be used to excite the embodiment depicted in FIG. 3(*a*);

FIG. 3(*c*) is a developed plane view diagram of the embodiment shown in FIG. 3(*a*);

DETAILED DESCRIPTION

Figure 1B:
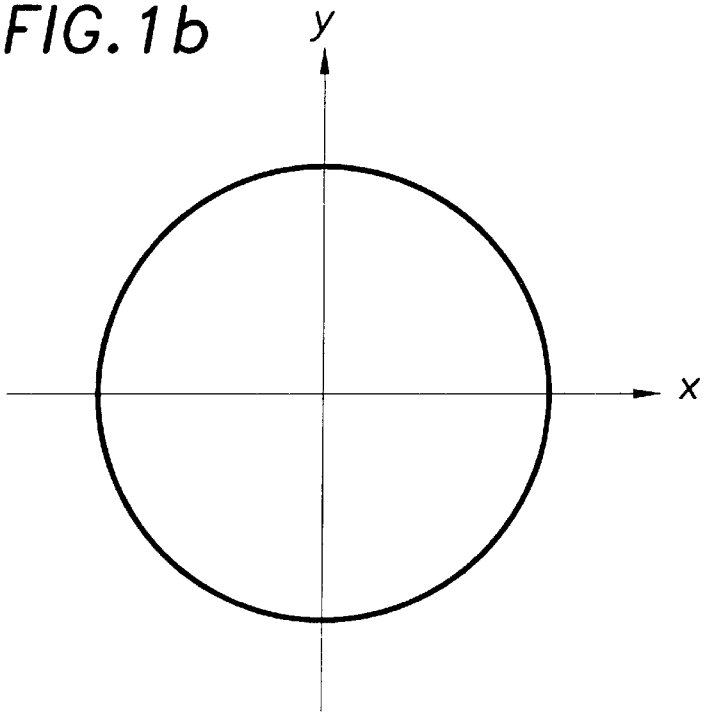

The antenna element of the present invention comprises a dual polarized slot-dipole antenna that is useful in a variety of applications including satellite communications, wireless communications, and FM broadcasting. The present invention, which is directed toward an antenna having a small cross-section cavity of less than one quarter-wavelength by one quarter wavelength, overcomes some of the above-described limitations of prior art antennas, including slot-dipoles. The antenna could contain a single slot or a series of slots that are evenly spaced circumferentially. Generally speaking, the antenna of the present invention can be made of thin conducting sheets, where one edge of the sheet could be rolled up over itself, for the one slot case or over the next sheet for the multiple slot case, and separated by an insulating sheet to form a capacitative strip loaded slot.

The present invention overcomes shortcomings of prior art slot-dipole antennas by utilizing the external body of a slender cavity backed slot as an electric dipole. The transverse cross-section of a slender cavity, representing a virtual short circuit across the slot, renders the antenna ineffective. In the present invention, that short circuit is recognized as a shunt inductance along each slot and a capacitive strip is made to cancel the shunt inductance and the cavity resonant. In order to eliminate feed line interference, a hollow shaft could be used to house feed lines.

In order to more fully understand the theory behind the present invention, a brief discussion of the underlying mathematics is included. When the transverse dimensions of a basic resonant structure are small compared to a wavelength of interest, its electrical properties can be characterized by lumped elements obtained from static field approximations. This leads to a one-turn inductor and a strip parallel-plate capacitor. The corresponding inductance and capacitance are given by:

$$L_1 = \mu_0 \mu_r \frac{A}{l} \tag{1}$$

$$C_1 = \varepsilon_0 \varepsilon_r \frac{sl}{t} \tag{2}$$

where:

$_0$=permeability in a vacuum;

$_r$=relative permeability of the core material, excluding the shaft, in the center area;

A=cross-sectional area of the center core excluding any center-shaft area;

$_0$=permittivity in a vacuum;

$_r$=relative permittivity of the insulating material in the overlapped area;

$_s$=overlap width for a single slot;

l=axial length along the slot; and t=overlap dielectric thickness for a single slot.

When the antenna is comprised of n evenly spaced slots, partitioned inductance and capacitance corresponding to equations (1) and (2) become:

$$L_n = \mu_0 \mu_r \frac{A}{nl} \tag{3}$$

$$C_n = \varepsilon_0 \varepsilon_r \frac{nsl}{t} \tag{4}$$

where:

n=total number of slots.

Using Equations (1) through (4), it is apparent that $L_1C_1=L_nC_n$. Adding slots in different embodiments of the present invention, therefore, does not affect the antenna's transverse resonant frequency. As the antenna cross-section is increased and its circumference approaches one-half wavelength of the operating frequency, the nominally circular radiation pattern in the plane perpendicular to the antenna becomes distorted. This negative effect can be counteracted by adding additional slots to the perimeter of the antenna. These slots, which can be fed in a parallel fashion, serve to extend the fundamental mode high frequency limit. Adding additional slots to the antenna can also be an effective way to minimize the adverse effects of stray capacitance. When stray capacitance dominates total capacitance, which can occur when the overlap becomes too small, resulting in less predictable antenna performance, the number of slots can be increased, thereby increasing the total overlap on the antenna.

Returning to Equations (1) through (4), these equations assume uniform current density flowing circumferentially. Neglecting stray capacitance at the slot and at the beginning of the overlap due to the fringing field, the transverse resonant frequency, or the cutoff frequency for longitudinal propagation, $f_c$, is given by:

$$f_c = \frac{1}{2\pi\sqrt{L_1 C_1}} = \frac{V_0}{2\pi\sqrt{\mu_r \varepsilon_r}}\sqrt{\frac{t}{As}} \tag{5}$$

where:

$V_0$=speed of light in a vacuum.

If the slot is short-circuited at one end and open at the other, a shallow, resonant, slotted cavity is formed. The resonant frequency in this situation, $f_r$, is given by:

$$f_r = \left(\frac{V_0^2 t}{4\pi^2 \varepsilon_r \mu_r As} + \frac{V_0^2}{16\varepsilon_r \mu_r l^2}\right)^{1/2} \tag{6}$$

The reactive energy stored in the slot is small compared to that in the cavity and strip capacitor, thereby resulting in a negligible slot susceptance compared to that of the shallow cavity. Finally, antenna efficiency and 3 dB bandwidth product are given by the following equation:

$$\xi W = 4\pi^2 \mu_r \eta_0 G_r \frac{A}{\lambda_0^2} \tag{7}$$

where:

$\xi$=antenna efficiency;

W=3 dB bandwidth due to radiation alone;

$\mu_r$=relative permeability of the core material in the center of the antenna;

$\eta_0$=intrinsic impedance of free space (377 ohms);

$G_r \approx 50$ millimhos for radiation in free space;

A=cross-sectional area of center core excluding any center shaft area; and $_0$=wavelength.

One effective way to increase the slot antenna bandwidth for all frequencies is to increase the diameter of the conducting cylinder. When the circumference of the cylinder approaches one-half wavelength of the operating frequency, however, the desired circular radiation pattern perpendicular to the slot of the antenna becomes distorted. In addition, the optimized overlapping capacitance becomes small and the edge-fringing capacitance dominates the antenna's resonant characteristics, resulting in unpredictable antenna performance. The present invention overcomes the distortion in the radiation pattern and the negative effects of edge-fringing capacitance by using multiple capacitive loaded or overlapped slots. Embodiments of the present invention further mitigate the negative effects that can be caused by feed lines, e.g., interference or stray radiation, by including a hollow, conductive shaft within the antenna body for housing feed lines and additional components.

By using additional slots and individual feed points for each of these slots, the antenna cross-sectional area can be increased beyond $0.003^2$, or the equivalent diameter for 0.06. It is also possible when using additional slots to maintain a substantially omnidirectional pattern, e.g., less than 0.9 dB, in the plane perpendicular to the antenna axis. According to Equation (7), an increase in cross-sectional area, A, results in an increase in antenna bandwidth. Usually, however, an engineer is limited by his or her operating environment when it comes to the cross-section size of the antenna.

Figure 1C:
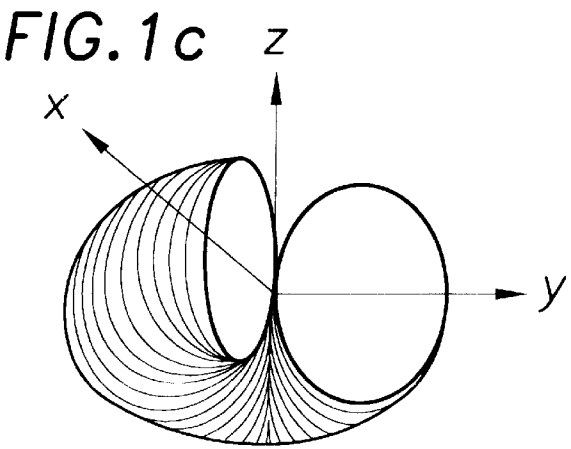
Figure 1A:
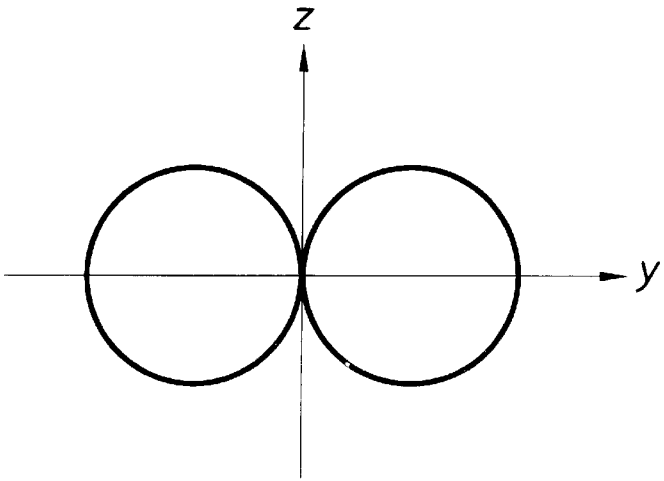

The diagrams of FIG. 1 represent the theoretical radiation patterns of the present invention. With reference to FIG. 1(*a*), the theoretical radiation pattern in the y-z plane is a figure-eight pattern. FIG. 1(*b*) depicts an omnidirectional radiation pattern of the inventive antenna in the x-y plane, while FIG. 1(*c*) shows the doughnut-shaped radiation pattern of the present invention in three-dimensional space. In the x-y plane, the dipole of the present invention could transmit a z-directed, vertically polarized electric field, while the slot could transmit a horizontally polarized electric field in the x-y plane.

Figure 2:
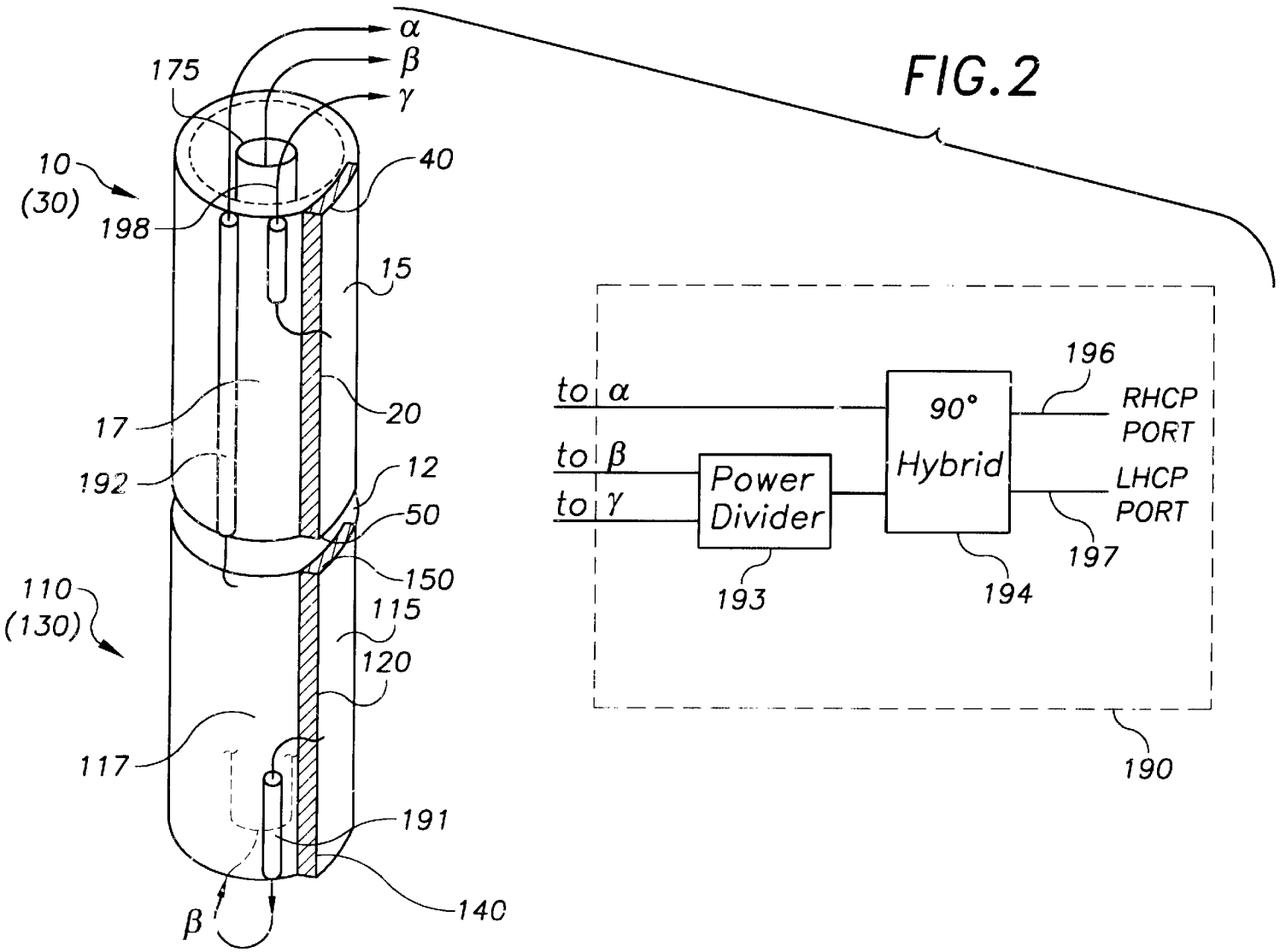
FIG. 2 is a perspective view of one embodiment of the invention wherein the antenna has one slot.

An embodiment of the present invention is shown in FIG. 2. In this embodiment, two linearly polarized antennas, a dipole and a slot on a cylinder, act in concert to create a dual-polarized antenna. As can be seen from FIG. 2, the slot-dipole combination of the present invention is housed within the same physical construct. In fact, each embodiment discussed below features at least one slot collocated with at least one dipole. This collocation distinguishes the embodiments of the present invention over the prior art by allowing the present invention to operate in a more efficient manner, and to be easily implemented. The collocation of the dipole and the slot antenna components and the non-interfering feed line arrangement of the embodiments of the inventive antenna ensures the fulfillment of the near-ideal dipole/loop E-H complimentary radiation pattern, i.e., an omnidirectional, circular, doughnut shaped pattern over the entire horizontal plane (perpendicular to the antenna axis) and a figure-eight pattern in the planes containing the antenna axis, as was shown in FIG. 1.

With reference to FIG. 2, the antenna of this embodiment comprises first 10 and second 110 substantially cylindrical members. In addition, a first edge 15, 115 of the outer surface of the antenna can be folded over a second edge 17, 117 of the outer surface of the antenna. In this way, first 20 and second 120 capacitive loaded slots can be created. From a physics point of view, a slot cannot radiate energy if it is unable to maintain a voltage across its longitudinal edges. If the cavity behind the slot is too shallow, an effective short circuit is formed. By rolling a first edge 15, 115 over a second edge 17, 117, the transverse capacitive and inductive impedances can cancel each other out, resulting in resonance and permitting a voltage to exist across the first 20 and second slots 120. This phenomenon creates an effective radiating element. A shallow cavity with the requisite capacitance is created in this embodiment by wrapping the first edge 15, 115 of a surface over the second edge 17, 117 of the surface as is shown in FIG. 2.

As is well known in the art, the first 20 and second slots 120 perform like one-turn loops, creating an electric field that encircles the first 10 and second substantially 110 cylindrical members. When the first 10 and second 110 cylindrical members of this embodiment are excited as an electric dipole antenna, the electric field generated will provide components orthogonal to the fields due to the presence of the first 20 and second slots 120. Thus the first and second substantially cylindrical members function as dipole components in this embodiment. A first dipole component 30 and a second dipole component 130 are shown in FIG. 1. Because the first 10 and second 110 substantially cylindrical members and the first 30 and second 130 dipole components are physically indistinguishable in the presence of a source of excitation, they are shown as such in FIG. 1. The first 20 and second slots 120 transmit or receive horizontal polarization, while a first 30 and second dipoles 130 could transmit or receive vertically polarized waves. This combination of components transmitting or receiving orthogonal linear polarizations can result in a circularly polarized antenna. The dipole and slot elements used in an embodiment of the present invention could be designed to resonate at approximately the same center frequency. In order to make the antenna element of the embodiment depicted in FIG. 2 an active element, this embodiment could further comprise a feeding network 190.

With reference to FIG. 2, the active portions of the first 30 and second 130 dipole are separated by a transverse gap 12, which can be filled with an insulating material. This gap 12 is shown as a transverse gap. It will be understood by those skilled in the art that the gap 12 need not be transverse and could, for example, be slanted. The gap 12 can be comprised of free space. Alternatively, an insulating material with a low dielectric constant could be placed between the two substantially cylindrical members 10, 110 to provide structured rigidity to the antenna. This material could be foam, Teflon, polyolefin, or polyflon. For each slot-pair, i.e., the first 20 and second slots 120, a first end 50 of the first slot 20 is an open circuit, while a second end 40 of the first slot 20 is a short circuit. Similarly, a first end 150 of the second slot 120 is an open circuit, while a second end 140 of the second slot 120 is a short circuit.

In general, the first 10 and second 110 substantially cylindrical members could be fabricated from any type of conducting metal, such as copper or aluminum. In addition, the first 10 and second 110 substantially cylindrical members may have a smooth outer surface, as would be the case if the cylindrical members were fabricated with standard thin sheet or foil aluminum. Alternatively, the outer surface of the first 10 and second 110 substantially cylindrical members could be comprised of braided wire or wire net. If the outer surface of the first 10 and second 110 substantially cylindrical members was comprised of braided wire, the antenna would be more flexible and may be used in applications where the antenna must be compactable prior to being deployed.

Figure 4A:
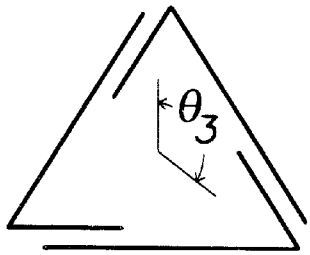
FIGS. 4(*a*), (*b*), and (*c*) are diagrams of polygonal embodiments of the present invention.
Figure 4B:
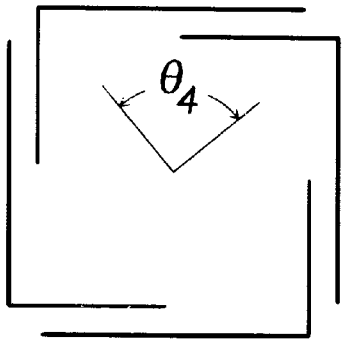
Figure 4C:
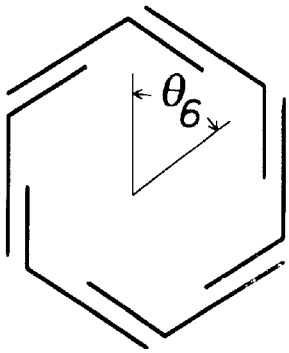

In addition, one skilled in the art should recognize that this embodiment, while pictured as cylindrical, could be triangular, square, hexagonal, or any other regular polygonal shape as shown in FIGS. 4(*a*)–(*c*) without substantially altering the antenna's performance. In this preferred embodiment, two feed lines 198 and 191, could be coupled with the first 20 and second 120 slots, respectively, at the appropriate distance from the shorted end so that the slots will present approximately the same impedance as the feeding transmission line. The first 30 and second 130 dipole elements could be fed by a single line 192 directly at the gap 12 or through an impedance transformer, if needed. In this embodiment, the feed lines could be attached to the radiating elements internally, through a shaft at the center of the cylindrical or polygonal members. In FIG. 2, the slot feeds 191 and 198 and the dipole feed 192 are affixed to the perimeter of the antenna. One skilled in the art will recognize that locating the feed lines in a shaft inside of the body of the antenna will not substantially degrade the antenna's performance.

One of the slot feeds 191 could traverse the gap 12 by being placed inside of a shaft 175, which would eliminate inadvertent electrical interference with dipole radiation. This shaft 175 could be used to house other necessary lines as well, such as optical fibers and DC supply lines. The shaft has the additional benefit of being able to provide structural integrity for the antenna element. The diameter of the shaft can vary, subject to the limitation that any area occupied by the shaft should be subtracted from the overall cross-section area of the center core, A, of Equation (7). Referring to Equation (7), it can be seen that reducing the effective cross-section area of the center core, A, reduces the antenna efficiency and 3 dB bandwidth product.

To achieve polarization diversity, the antenna of the present invention can be connected to a feeding network 190. The feeding network could duplex two orthogonally linear, if the 90-degree hybrid 194 is omitted, or two circularly polarized ("CP") signals, if the 90-degree hybrid 194 is included, to or from, the embodiments described herein. A power divider 193 could be used for exciting the first 20 and second slots 120. The antenna of the present invention can be used as either a left-hand circularly polarized and/or a right-hand circularly polarized antenna. The circularly polarized wave of the present invention could be created using a 90-degree hybrid 194 to combine the horizontally y polarized wave from the slot with the vertically polarized wave from the dipole. The direction of rotation, or handedness, of the resultant circularly polarized wave depends upon which of the linearly polarized components leads in phase. In a preferred embodiment, right-hand CP can be provided via port 196; and left-hand CP can be provided by port 197. If only left-hand CP is needed, port 196 can be terminated by a load. Similarly, terminating port 197 with a load will allow the use of just right-hand CP. It is also possible to switch the handedness of the wave in this embodiment by switching back and forth between these ports.

In accordance with the principles of reciprocity, the antenna elements perform similarly when used to receive or transmit electromagnetic energy via the first 20 and second 120 slots and the first 30 and second 130 dipoles. An additional aspect of the present invention could, therefore, include an antenna configured to receive circularly polarized signals, or to alternate between transmitting and receiving circularly polarized signals.

In terms of the length of the first 10 and second 110 substantially cylindrical members, in a preferred embodiment, the length of these members could be approximately equal to one quarter of a wavelength of the operating center frequency. A person skilled in the art will readily appreciate that the length and diameter of the antenna of the present invention can be varied to suit various applications. Irrespective of what length is determined to be optimum, the length of the first substantially cylindrical member 10 should be nearly identical to that of the second substantially cylindrical member 110. A person skilled in the art will also recognize that one or both of the substantially cylindrical members could be physically subdivided into two or more sections, but electrically connected by two or more wires, without affecting the antenna's radiation characteristics, as was discussed in Joseph C. Lee, *A Slender-Resonator Slot UHF Antenna*, IEE Antenna Propagation Conference, publ.

195, 442–46 (1981), the contents of which are hereby incorporated by reference.

Figure 3A:
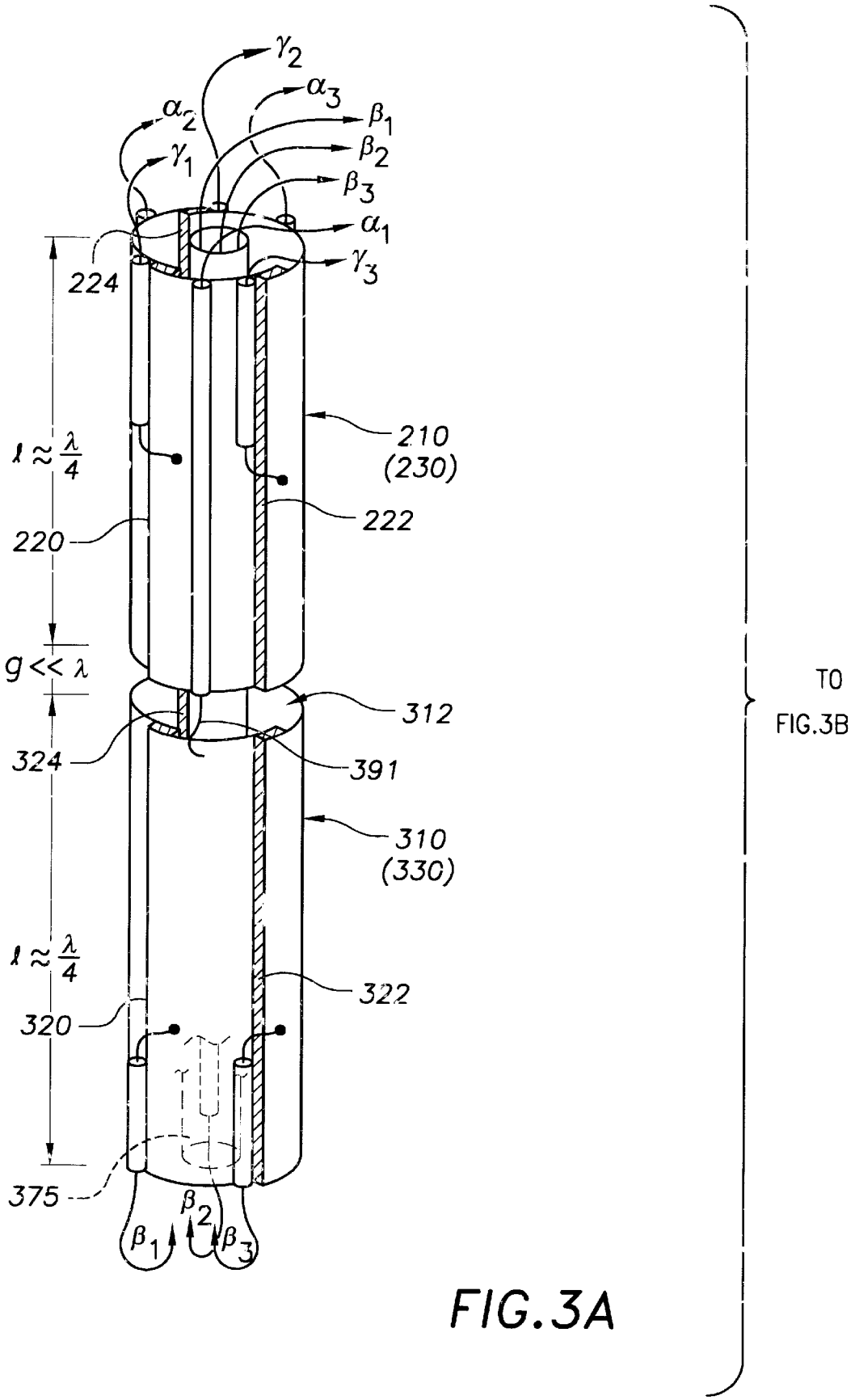
FIG. 3(*a*) is a perspective view of one embodiment of the invention wherein the antenna has three slots.
Figure 3B:
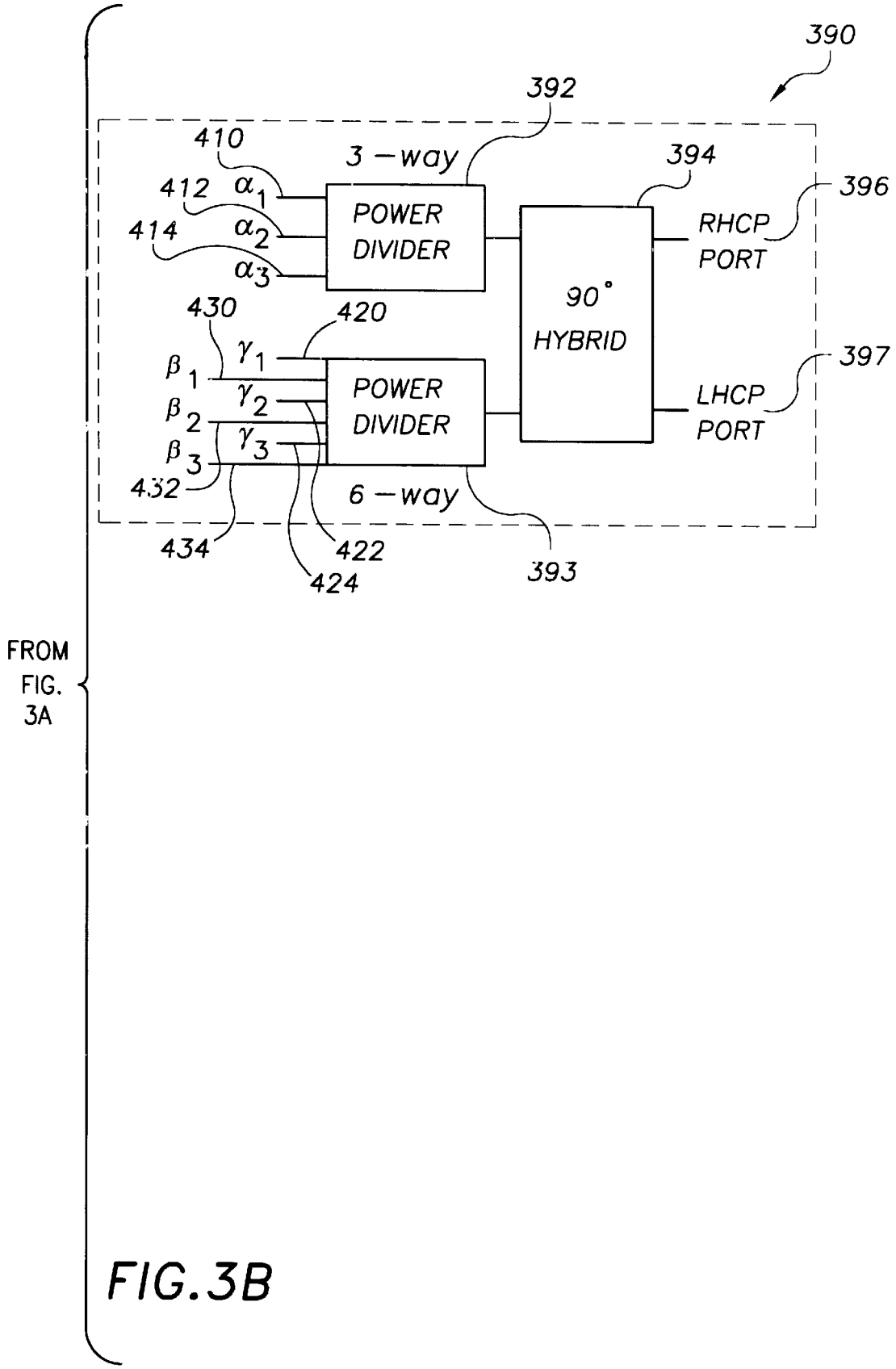
Figure 3C:
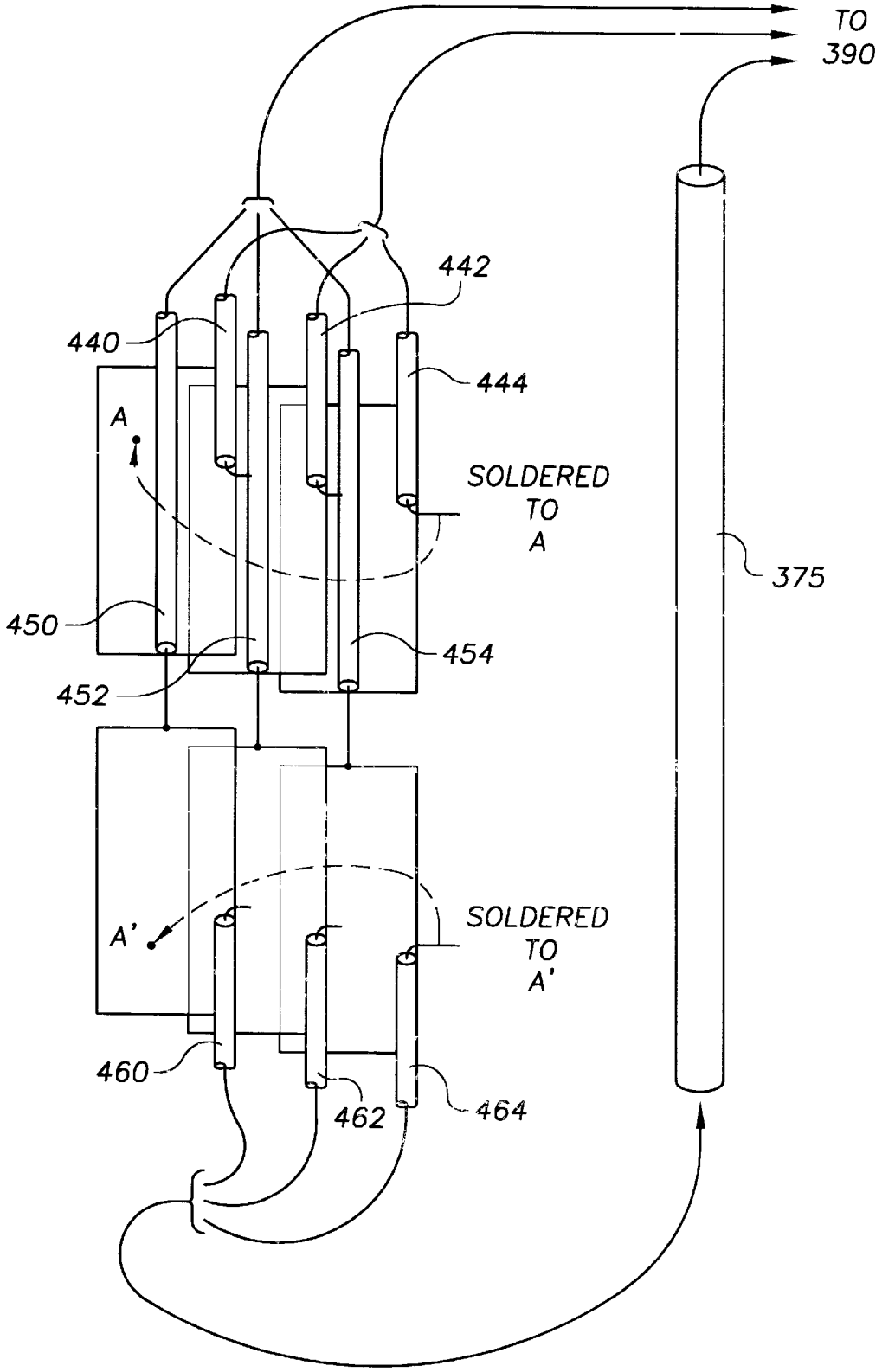

While the preferred embodiment depicted in FIG. 2 contains only one slot on the first 10 and second 110 substantially cylindrical members, it can be shown mathematically that adding additional slots to the exterior of the antenna will not change the radiation characteristics of the inventive antenna, provided that the slots are nearly evenly spaced around the perimeter of the antenna and parallelly and equally excited. The transverse resonant frequency given by Equation (5) is unaffected when additional slots are present as long as Equation (4) is followed. One axial slot can be used for small cross-section cases where the equivalent antenna diameter is not greater than approximately 0.06. As the cross-sectional diameter is increased for mechanical or electrical reasons, e.g., to increase the antenna's bandwidth, more circumferential and equispaced slots could be used. Adding slots to the exterior of the present invention maintains a circumferentially uniform current without appreciable phase delay, resulting in a uniform, omnidirectional radiation pattern in the plane perpendicular to the antenna axis. Accordingly, additional embodiments of the present invention could be comprised of a plurality of slots located on the exterior of the antenna body. FIG. 3(*a*) depicts a cross-sectional view of a substantially cylindrical embodiment containing three slots. FIGS. 4(*a*)–(*c*) are representative of polygonal embodiments containing a plurality of equispaced slots.

With reference to FIG. 3(*a*), the antenna of this embodiment is similar to the embodiment described with reference to FIG. 2. The embodiment shown in FIG. 3(*a*) is also comprised of first 210 and second 310 substantially cylindrical members. As was the case with respect to the embodiments of FIG. 2, the first 210 and second 310 substantially cylindrical members act as first 230 and second 330 dipole components when coupled to an excitation source. The embodiments of FIG. 3(*a*) also contain a gap 212, shown as transverse but not required to be transverse. In addition to the long slot, the antenna of this embodiment is a dual linear or circular polarized antenna. The same materials could be used to fabricate this embodiment. The length of the first substantially cylindrical member 210 should be nearly equal to that of the second substantially cylindrical member 310.

There are a total of six slots in the embodiment depicted in FIG. 3(*a*). First 220, second 222, and third slots 224 are located on the first substantially cylindrical member 210. Fourth 320, fifth 322, and sixth 324 slots are located on the second substantially cylindrical member 310. The slots of this embodiment can be formed by rolling a first edge of the outer surface over a second edge of the outer surface. A dielectric material can be used to preserve the structural integrity of the slots. One end of each slot is short-circuited, while the other end of each is an open circuit.

In addition, those skilled in the art should recognize that this embodiment, while pictured as cylindrical, could be triangular, square, hexagonal, or any other regular polygon shape. FIGS. 4(*a*), (*b*), and (*c*) are sketches of multiple slots located on antennas having triangular, square, and hexagonal cross-sections, respectively. In each of these embodiments, the slots should be spaced nearly equidistantly around the perimeter of the antenna, except for the single slot case.

With reference to FIG. 3(*a*), a shaft 375 can be used to house the feed lines for slots 320, 322, 324 through the lower end or 220, 222, and 224, and dipoles 230 and 330 through the upper end, if desired. One skilled in the art will recognize that alternative means for arranging the feed lines so that they do not interfere with the inventive antenna's radiation could be used in lieu of the shaft 375, both in this embodiment and in the previous embodiment discussed with reference to FIG. 2. Similarly, while the shaft 375 is depicted as having a circular cross-section, any cross-section shape could be substituted without substantially altering the performance of this embodiment or the embodiment discussed above with reference to FIG. 2.

In terms of a feeding network for the plurality of slots in this embodiment, the multiplicity of slots could be fed by individual lines from an n-way power divider where "n" represents the number of slots present in the particular embodiment. An exemplary feeding network 390 is shown in FIG. 3(*b*). This feeding network 390 is comprised of a two power dividers, 392, 393, 90-degree hybrid 394, a right hand circularly polarized port 396, and a left hand circularly polarized port 397. In addition, n feed line connections are shown. In this embodiment, n=3, therefore, three feed lines are depicted. Given that n=3, the embodiment depicted in FIG. 3(*a*) shows a total of six slots in first 210 and second 310 substantially cylindrical members. Although there is only one dipole component in each of the first 210 and second 310 substantially cylindrical members, these dipole components are segmented because of the three slots located on each. As such, it may be desirable to provide three distinct feed points for the three segments of the dipole component depicted in FIG. 3(*a*). These three dipole connections, $_1$, $_2$, and $_3$, are shown at 410, 412, and 414 in FIG. 3(*b*). A first power divider 392 can be used to excite the three segments of the dipole 230 component of the first 210 substantially cylindrical member and of the second dipole component 330 of the second 310 substantially cylindrical member. With reference to FIG. 3(*a*), one of these connections is shown at 391. The dipoles in these embodiments could be fed via a single feed line, as was the case with the earlier single-slot embodiment. More feed lines ensure longitudinal current uniformity in any cross-section.

In terms of powering the six slots of this embodiment, a second power divider 393 can be used to excited the slots. FIG. 3(*b*) shows connection points for the slots located in the first 210 substantially cylindrical member, $_1$, 420 $_2$, 422 and $_3$ 424, as distinct from those located in the second 310 substantially cylindrical member, $_1$ 430, $_2$ 432, and $_3$ 434. Alternatively, less than n feed lines could be used to power some slots in each substantially cylindrical member, while capacitive coupling could be used to feed the additional slots. More feed lines from a power divider ensure a circumferentially uniform current distribution. These feed lines could be attached to the perimeter of the antenna or housed within the shafts 375. One skilled in the art will recognize that the embodiment discussed earlier with reference to FIG. 2 could similarly be comprised of feed lines attached to the perimeter of the antenna or housed within the shaft 175.

FIG. 3(*c*) shows a developed plane view of power connections for the embodiment of FIG. 3(*a*). The three feed lines for the three slots 220, 222, and 224 of the upper half of the antenna are shown at 440, 442, and 444, respectively. Similarly, the three feed points for the three segments of the first dipole component 230 of the upper half are shown at 450, 452, and 454, respectively. The feed lines for the three slots located in the lower half of the antenna, 320, 322, and 324, are shown at 460, 462, and 464. These three feed lines could be housed within the shaft 375 if so desired. The feed lines and duplexing components depicted in FIGS. 2 and 3(*a*)–(*c*) could be coaxial, stripline, or microstrip form.

Likewise, this embodiment could be used as a receive or transmit antenna, or could alternate between transmitting and receiving. If high permeability material exists for the operational frequency, the space between the shaft and the antenna's outer cylinder can be filled with this material to increase the antenna's gain bandwidth product without increasing the antenna's cross-section size.

The present invention can be used as a stand-alone antenna or as an element of an antenna array. For example, adjacent antenna elements similar to those pictured in FIGS. 2 or 3(*a*) could be lined up along the longitudinal axis to form a slender linear array.

In the embodiments disclosed thus far, the bandwidth of the dipole may be larger that of the slot. If an engineer wishes to increase the bandwidth of the slot, several design techniques are available for use with the present invention. The engineer may, for example, add external reactive resonant or resistive elements to the antenna. Drawbacks of this technique are increased mismatch and dissipative losses.

In an alternative embodiment, the diameter of the substantially cylindrical members could be increased. Similarly, the width of the substantially polygonal members could be increased. The bandwidth of the slot is substantially proportional to the cross-section area divided by the square of the wavelength of the antenna. Although an engineer may not be at liberty to substantially alter the operating frequency, he or she could increase the antenna's cross-sectional area as a means of increasing the slot's bandwidth. In addition to the practical limitations inherent in increasing the size of the antenna, one skilled in the art will appreciate that the diameter of the substantially cylindrical members, or width of the polygonal members, should not be increased beyond 0.06 because the resulting radiation pattern will lose its uniform omnidirectional characteristic. Using multiple parallel slots in alternative embodiments can circumvent this limitation because these additional slots increase the capacitive loading around the cavity enclosure.

Another method of increasing the bandwidth of the slots, which is in fact limited to frequencies below 100 MHz, comprises filling the cavity with a high permeability ferrite material. Materials having a state-of-the-art high magnetic permeability do not exist above 100 MHz, making this option ineffective if the desired frequency operating range is higher than 100 MHz.

If an individual is seeking to practice the invention disclosed herein in a broad operating bandwidth, but with a fairly narrow instantaneous bandwidth, he or she could replace the slot loading capacitive strip wholly or partially with a varactor. By adding varactors, the engineer is able to tune the resonant frequency of the slot. Although the actual bandwidth of the slot is not increased when a varactor is added to any of the embodiments disclosed herein, the antenna in this embodiment would be able to operate within a greater frequency range by altering the resonant frequency of the slots. See M. S. Smith, et al., *A UHF Buoyant Antenna*, 1987 ICAP, 273. The dipole, because of its inherent broadband characteristics, can remain unchanged in this embodiment.

In order to verify his theoretical predictions, the inventor tested two embodiments of the invention disclosed herein. In the first of these tests, the antenna used was similar to that described earlier with reference to FIG. 2. The first test antenna was comprised of two substantially cylindrical members, each having one slot. The circumference of the cylinders was approximately 0.08. The second test antenna was similar to that depicted in FIGS. 3(*a*)–(*c*), except it contained four slots with a square cross-section of 0.55 circumference, rather than the three slots with circular cross-section shown in FIG. 3(*a*). Aside from the number of slots on the perimeter of each antenna, the measured radiation pattern of the two test antennas were very similar. In particular, the length of the two substantially cylindrical members of both test antennas was approximately one-half wavelength. The square cross-section antenna tested had a much larger gain-bandwidth than that of the smaller circular cross-section antenna tested. The outer surface of both antennas was copper.

The test environments used, as well as the analysis conducted on each antenna, were also similar. Both return loss and isolation tests were conducted in a traditional laboratory setting without the benefit of any electromagnetic absorbing materials. The patterns were measured in an anechoic chamber designed for higher frequencies than were actually used during these test. Had these tests been conducted in an anechoic chamber designed for the operation frequencies of the embodiments tested, one would expect results even more closely matched the theoretical results obtained from the equations. Under analysis, both antennas yielded similar results, as would be expected from the theoretical calculations included herein. As such, only the results obtained from measurements performed on the single slot/dipole antenna are included herein.

The length of each substantially cylindrical member of the single-slot test antennas was 12", while the diameter was 1". The core was composed of Phenolic. The antenna was wrapped with Polyolefin, while the entire structure was clad with a copper surface about 36 microns thick. The feeding network consisted of a power divider. A semi-rigid 50 Ω with an outer diameter of 0.94 mm was used to feed the slots and dipoles. The point of excitation of the slots was determined experimentally for the best impedance match. The resonant frequency of the slots was 285 MHz, while that of the dipoles was 222 MHz. Since the bandwidth of the dipoles was broad enough to cover the slots' resonant frequency, the test was conducted at 285 MHz.

Figure 5:
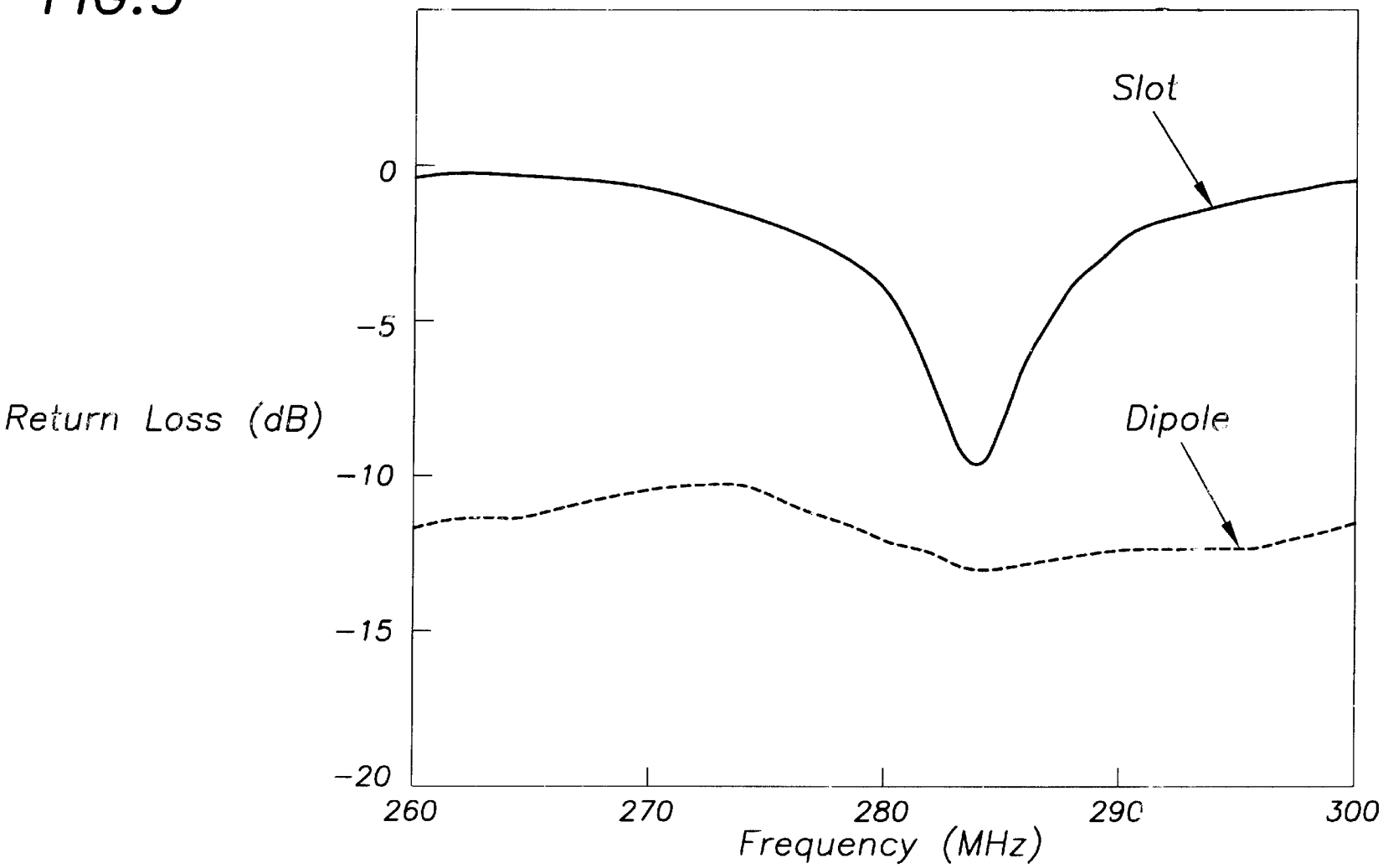
FIG. 5 is a plot of the measured return losses for one embodiment of the present invention.
Figure 6:
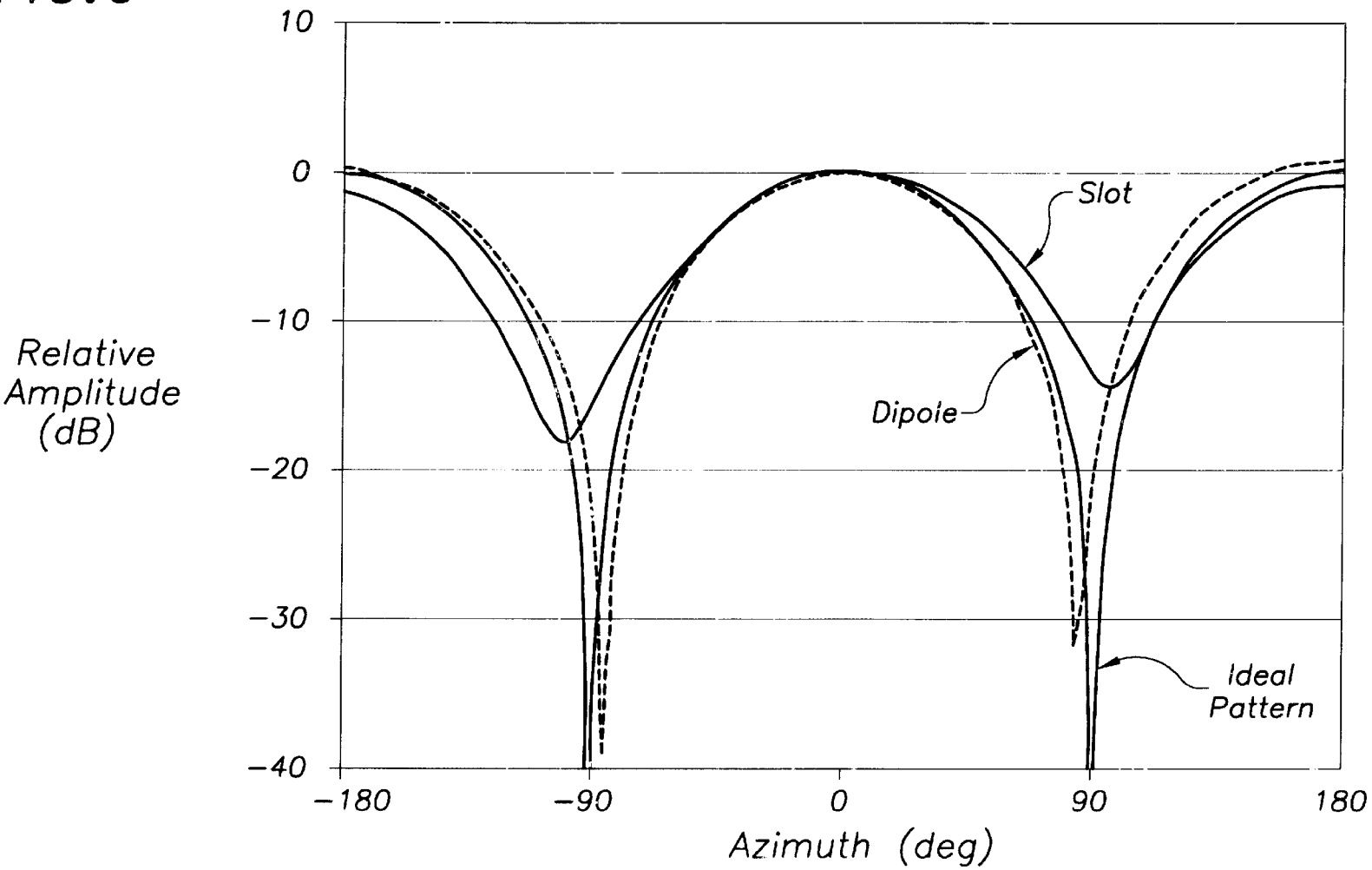
FIG. 6 is a plot of the elevation cuts radiation pattern of one embodiment of the disclosed invention; and, FIG. 7 is a plot of the isolation measured between a slot and a dipole in one embodiment of the invention.
Figure 7:
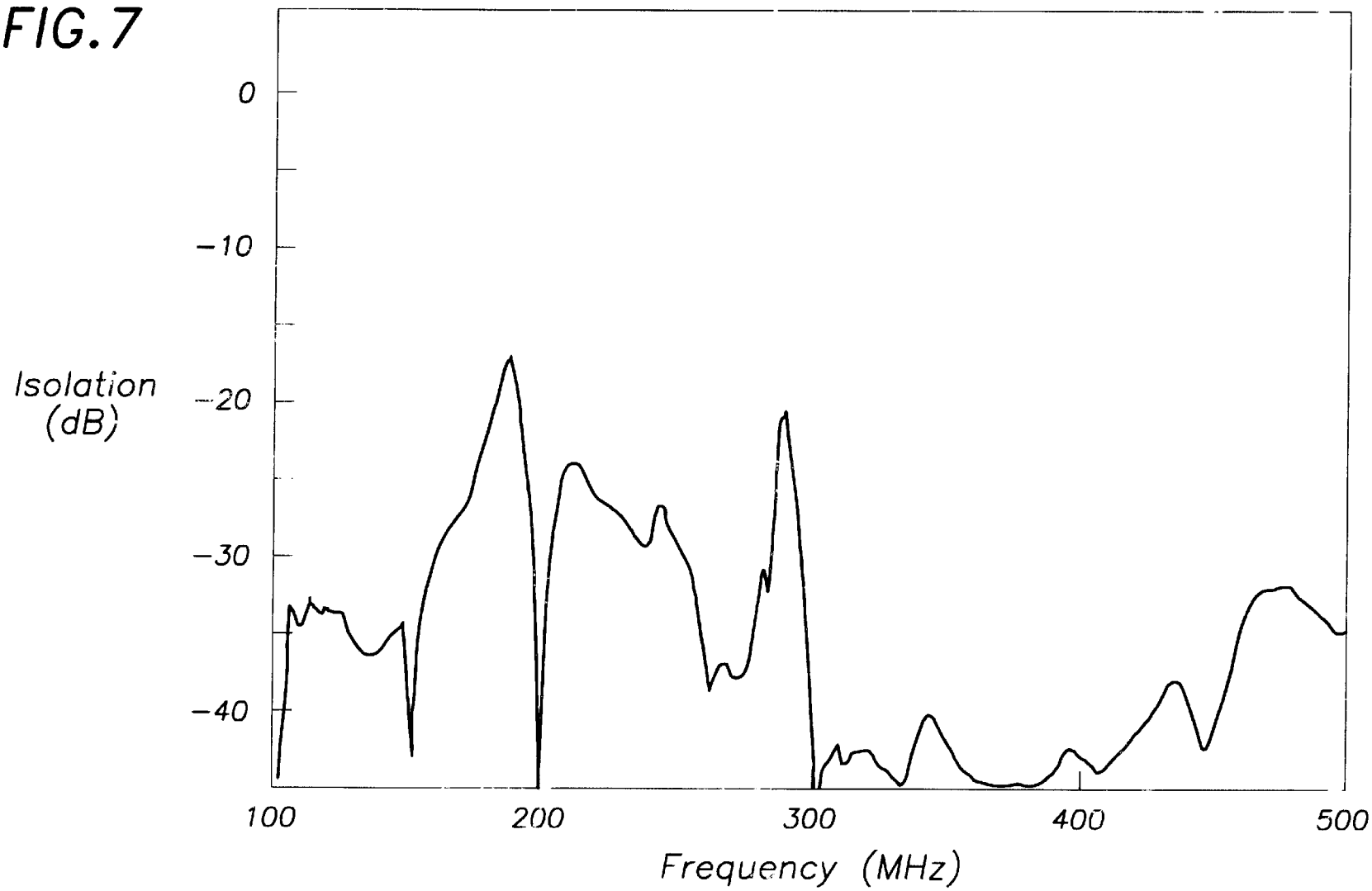

FIG. 5 depicts the measured return losses for a single slot embodiment of the present invention. FIG. 6 illustrates the radiation patterns obtained during the test of this single slot embodiment. As can be seen, the measured relative amplitude closely matched the theoretical amplitude. As can be seen from FIG. 6, the field is omnidirectional around the axis of the substantially cylindrical members, having nulls at the shorted ends of the slots. FIG. 7 shows that adequate isolation was obtained between the slot and the dipole feeds. If the test had been conducted in an anechoic chamber, it is likely that the isolation measurements would have been even better than those depicted in FIG. 7.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. An antenna element comprising:

a first and second substantially cylindrical member, wherein the first and second substantially cylindrical members are used as first and second dipole components and the dimensions of the first and second substantially cylindrical members are nearly equal;

a capacitively loaded-first-and second slot located on the outer surface of the first and second substantially cylindrical members, wherein the capacitively loaded first and second slots are further comprised of a longitudinal gap between two adjacent edges of the substantially cylindrical members;

a first end of the first and second capacitively loaded slots is a short circuit, wherein the first end is located furthest from a transverse gap between the first and second substantially cylindrical members; and a second end of the first and second capacitively loaded slots is an open circuit, wherein the second end is located closest to the transverse gap between the first and second substantially cylindrical members.

2. An antenna element comprising:

a first and second substantially cylindrical member, wherein the first and second substantially cylindrical members are used as first and second dipole components and the dimensions of the first and second substantially cylindrical members are nearly equal;

a plurality of capacitively loaded slots nearly equispaced around the outer surfaces of the first and second substantially cylindrical members, wherein the plurality of capacitively loaded slots are further comprised of a longitudinal gap between two adjacent edges of the substantially cylindrical members;

a first end of the plurality of capacitively loaded slots forms a short circuit, wherein the first end is located furthest from a transverse gap between the first and second substantially cylindrical members; and a second end of the plurality of capacitively loaded slots forms an open circuit, wherein the second end is located closest to the transverse gap between the first and second substantially cylindrical members.

3. An antenna element comprising:

a first and second substantially polygonal member, wherein the first and second substantially polygonal members are used as first and second dipole components and the dimensions of the first and second substantially polygonal members are nearly equally;

a first and second capacitively loaded slot located on the outer surface of the first and second substantially polygonal members, wherein the first and second capacitively loaded slots are further comprised of a longitudinal gap between two adjacent edges of the substantially polygonal members;

a first end of the first and second capacitively loaded slots is a short circuit, wherein the first end is located furthest from a transverse gap between the first and second substantially polygonal members; and a second end of the first and second capacitively loaded slots is an open circuit, wherein the second end is located closest to the transverse gap between the first and second substantially polygonal members.

4. An antenna element comprising:

a first and second substantially polygonal member, wherein the first and second substantially polygonal members are used as first and second dipole components and the dimensions of the first and second substantially polygonal members are nearly equally;

a plurality of capacitively loaded slots nearly equispaced around the outer surfaces of the first and second substantially polygonal members, wherein the plurality of capacitively loaded slots are further comprised of a longitudinal gap between two adjacent edges of the substantially polygonal members;

a first end of the plurality of capacitively loaded slots forms a short circuit, wherein the first end is located furthest from a transverse gap between the first and second substantially polygonal members; and a second end of the plurality of capacitively loaded slots forms an open circuit, wherein the second end is located closest to the transverse gap between the first and second substantially polygonal members.

5. The antenna element of claim 1 or 2, wherein the length of the first and second substantially cylindrical members is nearly equal to $\lambda/4$, wherein $\lambda$ is approximately the wavelength of the center frequency of the operating band.

6. The antenna element of claim 3 or 4, wherein the length of the first and second substantially polygonal members is nearly equal to $\lambda/4$, wherein $\lambda$ is approximately the center frequency of the operating band.

7. The antenna element of claim 1, 2 3, or 4, further comprising a shaft.

8. The antenna element of claim 7, wherein the shaft is hollow and conducting.

9. The antenna element of claim 1 or 2, further comprising a source of wave energy.

10. The antenna element of claim 3 or 4, further comprising a source of wave energy.

11. The antenna element of claim 9, wherein the source of wave energy is coupled to a radiating element proximal to the first or the second substantially cylindrical member.

12. The antenna element of claim 10, wherein the source of wave energy is coupled to a radiating element proximal to the first or the second substantially polygonal member.

13. The antenna element of claim 9, wherein the source of wave energy transmits or receives linearly polarized waves.

14. The antenna element of claim 10, wherein the source of wave energy transmits or receives linearly polarized waves.

15. The antenna element of claim 9, wherein the source of wave energy transmits or receives circularly polarized waves.

16. The antenna element of claim 10, wherein the source of wave energy transmits or receives circularly polarized waves.

17. The antenna element of claim 9, wherein the source of wave energy includes a 90° hybrid and a power divider.

18. The antenna element of claim 10, wherein the source of wave energy includes a 90° hybrid and a power divider.

19. The antenna element of claim 1, 2, 3, or 4, further comprising a core material.

20. The antenna element of claim 19, wherein the core material is a high permeability material.

21. The antenna element of claim 19, wherein the core material is a dielectric material.

22. The antenna element of claim 1, 2, 3, or 4, further comprising a dielectric material located between the edges of at least one slot.

23. The antenna element of claim 1, 2, 3, or 4, further comprising a varactor.

24. The antenna element of claim 1, 2, 3, or 4, further comprising an external reactive resonant component.

25. The antenna element of claim 1, 2, 3, or 4, further comprising a dissipative loss element.

* * * * *